United States Patent [19]

Foshee

[11] 4,424,691

[45] Jan. 10, 1984

[54] PULL-RESISTANT CYLINDER LOCK

[75] Inventor: William R. Foshee, Indianapolis, Ind.

[73] Assignee: Best Lock Corporation, Indianapolis, Ind.

[21] Appl. No.: 354,815

[22] Filed: Mar. 4, 1982

[51] Int. Cl.[3] ..... E05B 63/00

[52] U.S. Cl. ..... 70/224; 70/416; 292/336.3

[58] Field of Search ..... 70/224, 416, 418; 292/336.3, 347, 356

[56] References Cited

U.S. PATENT DOCUMENTS 2,542,117 2/1951 Cerf ..... 70/224

3,955,387 5/1976 Best ..... 70/224

4,394,821 7/1983 Best ..... 70/422

*Primary Examiner*—Robert L. Wolfe

*Attorney, Agent, or Firm*—Barnes & Thornburg

[57] ABSTRACT

Increased knob pull resistance in a cylinder lock is obtained by providing the knob sleeve with an inner lug which engages in a bayonet slot in the key-actuated rollback cam sleeve so as to transmit knob pull to the cam sleeve and through such sleeve and its out-turned rollback cam to the fixed hub. Preferably, the resulting increased pull resistance is combined with that provided by forming the knob sleeve with a small stud which rides in a groove in the hub to transmit pull directly from the knob sleeve to the hub.

11 Claims, 4 Drawing Figures

PULL-RESISTANT CYLINDER LOCK

This invention relates to a cylinder lock, particularly to a lock providing high resistance to knob pull.

One method of attacking a cylindrical lock is to exert strong pull on the outside knob so as to forceably remove either the knob from its supporting knob sleeve or the knob sleeve from the chassis mounted in the door.

In prior art cylinder locks, the knob is carried by a knob sleeve which is rotatably mounted in a fixed chassis hub, and the knob sleeve is commonly held against pull from the chassis hub by an out-turned rollback cam which overlies the inner end of the chassis hub. Engagement of the cam with the hub serves to transmit outward pull on the knob and sleeve. Prior U.S. Pat. No. 3,955,387 of May 11, 1976 shows an example of such a prior cylindrical lock. In this, the knob sleeve not only carries the rollback cam, but is also provided with a small extra out-turned tab which rides in a rabbet groove at the inner end of the hub. Such out-turned finger is itself subject to bending and does not sufficiently increase the pull resistance provided by the out-turned rollback cam to give an overall pull resistance sufficient to meet a present standard.

Pull resistance has also been increased by providing the knob sleeve of a cylindrical lock with a stud projecting radially outward from its wall within the length of the fixed hub in which the sleeve is mounted, and to provide the hub with an inside circumferential groove in which the stud rides so as to transmit outward force from the knob sleeve directly to the hub by way of the stud. The stud and groove are constructed and arranged to permit rotation of the knob sleeve in the hub for actuating the rollback cam to move the bolt retractor and retract the latch bolt of the lock.

A cylinder lock of the type to which the invention is applicable comprises a chassis having a fixed cylindrical hub in which a knob sleeve for the outside knob is rotatably mounted. The knob sleeve may have an out-turned rollback cam overlying the inner end of the hub for engagement with the hub to transmit outward pull from the sleeve to the fixed hub. The knob sleeve preferably also carries a stud engaged in a groove in the hub as mentioned above. The outside knob sleeve conventionally contains a key-actuated cam sleeve or the like within its inner end which has a supplemental out turned rollback cam at its inner end positioned to overlie the inner end of the hub so as to be capable of transmitting outward pull from such cam sleeve to the hub. However, in prior art cylinder locks, such key-actuated cam sleeve has either not been effectively connected to the knob sleeve to increase the resistance of the knob sleeve to outward pull or has been connected thereto in a manner which interferes with convenient manufacture and service of the lock.

In accordance with the present invention, the knob sleeve has means such as a lug projecting radially inward from its outer wall within the length of the cam sleeve so as to define an outward facing edge inside the knob sleeve, and the cam sleeve has means, such as a circumferential slot, defining an inward-facing edge, and the parts are arranged so that such edges are positioned for engagement with each other to transmit outward pull from the knob sleeve to the cam sleeve. The rollback cam on the cam sleeve then serves to transmit such pull to the inner end of the fixed hub to enhance the pull resistance of the lock.

Desirably, the lug on the knob sleeve is adjacent the outer end of the cam sleeve, and the cam sleeve is provided with an entranceway to permit such lug to move into the circumferential slot in the cam sleeve. Such entranceway is desirably displaced circumferentially from the operative position of the lug in the slot when the cam sleeve is oriented in the knob sleeve for operation of the rollback cam in the installed arrangement of the lock parts. The circumferential slot and axial entranceway may be considered to form a bayonet lock slot for engagement with the lug on the knob sleeve.

The accompanying drawings illustrate the invention and show a preferred embodiment exemplifying the best mode of carrying out the invention as presently perceived. In such drawings.

Figure 4:
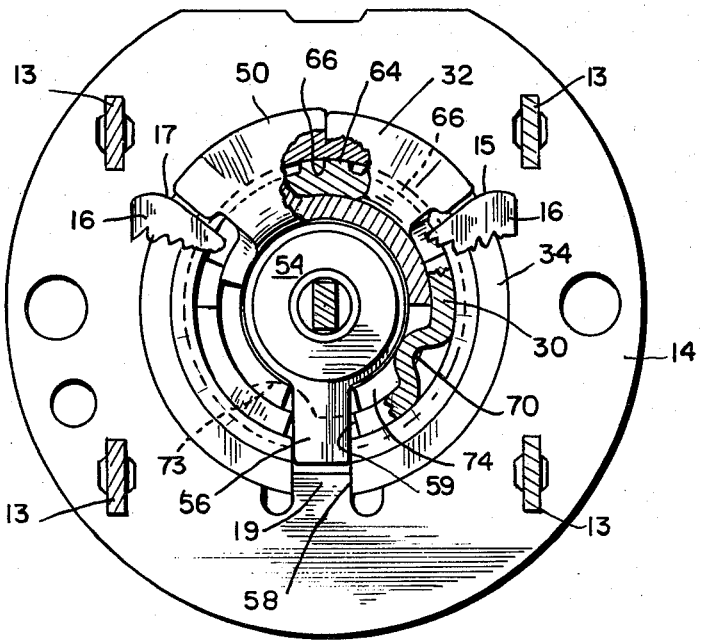
FIG. 4 is a section taken on the line 4—4 of FIG. 1.

The cylinder lock shown in the drawings comprises a chassis 10 having spaced, generally circular end walls 12 and 14 interconnected by a side wall having ears 13 engaged in the end walls as shown in FIG. 4. A retractor 16 is mounted in the chassis and connected to the tailpiece 18 of a latch bolt assembly 20. The two end walls 12 and 14 are connected, respectively, as end flanges on an inside hub 22 and an outside hub 24. The two hubs have external threads on which are mounted rose assemblies 26 and 28 which clamp against the sides of the door in which the chassis is mounted to hold the chassis in place. Each hub is locked against rotation relative to its connected flange wall 12 or 14 by engagement of a tongue 19 on the flange wall in a notch 58 formed in the end of the hub (see FIG. 4).

Figure 1:
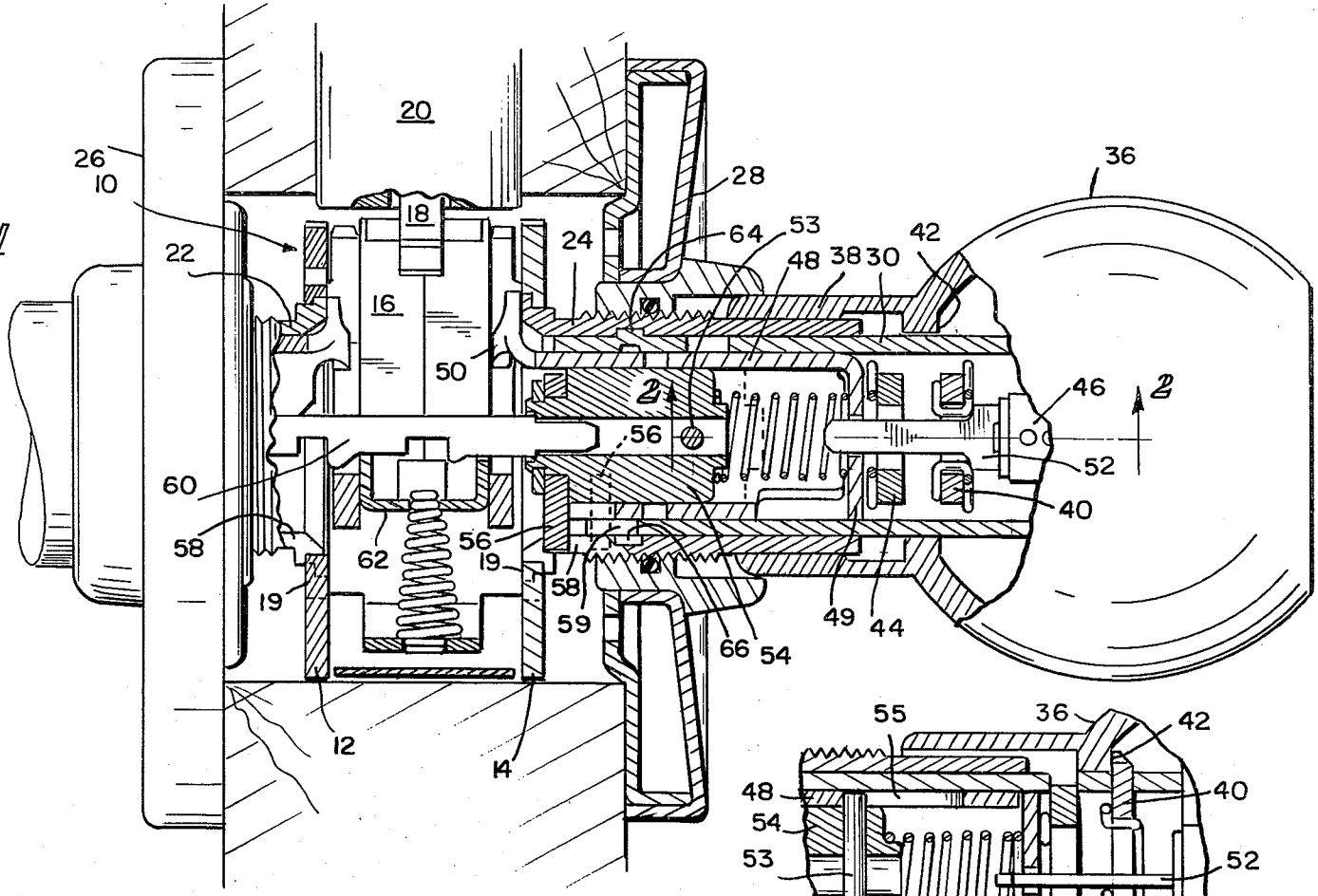
FIG. 1 is a partial axial section of a cylindrical lock embodying the invention.
Figure 2:
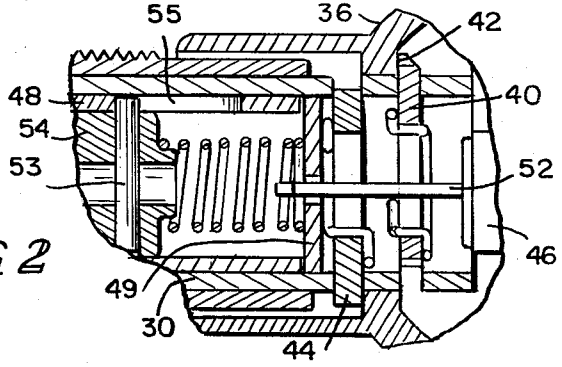
FIG. 2 is a fragmental section taken on the line 2—2 of FIG. 1.
Figure 3:
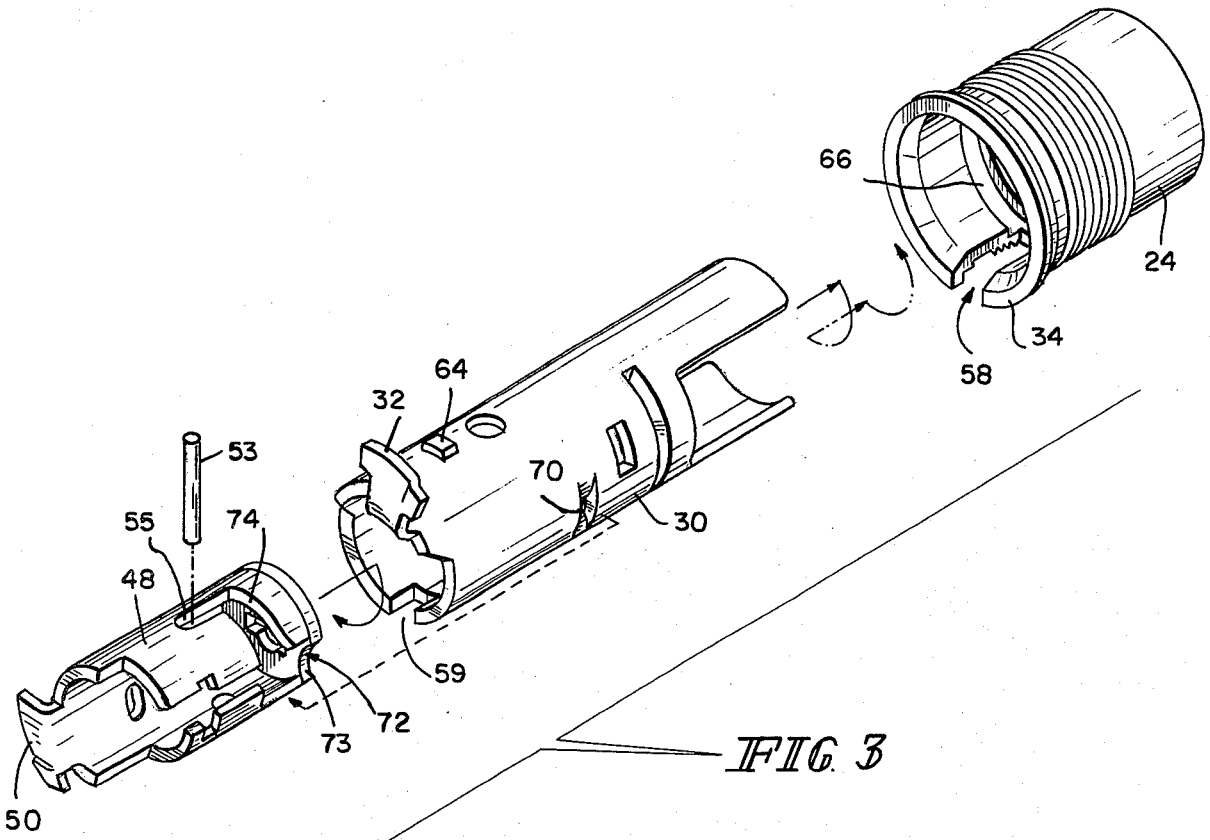
FIG. 3 is an exploded isometric view showing the interrelationship of the chassis hub, the outside knob sleeve, and the key-actuated rollback cam sleeve.

An outside knob sleeve 30 is rotatably mounted in the outside hub 24, with its outer surface in bearing engagement with the inner surface of such hub. The inner end of the knob sleeve carries an out-turned rollback cam 32 (see FIGS. 3 and 4) which overlies the inner end face 34 of the hub 24 so as to locate the knob sleeve axially within the hub 24 and transmit outward pull from the knob sleeve 30 to the hub 24. The outer end of the knob sleeve 30 carries a knob 36 having an outer hand grip portion and an inner neck portion 38 which is slidably received on the knob sleeve and which telescopes over the outer end of the hub 24. The knob is held in place on the knob sleeve by a knob retainer 40 mounted in diametric opposite slots in the knob sleeve and biased outward into overlying engagement with a shoulder 42 formed in the knob 36. The knob is held against rotation on the knob sleeve 30 by a driver 44 similarly mounted in diametrically opposite slots in the knob sleeve and engaged in an axial groove inside the neck portion 38. The knob retainer 40 and the driver 44 and their arrangement is more fully shown and described in copending application Ser. No. 270,825, filed June 5, 1981. The outer end of the knob sleeve 30, as shown in FIGS. 1 and 3, is formed with diametrically opposite wide slots for the reception of a key-operated core 46 mounted in the knob.

A key-actuated roll-back cam sleeve 48 is mounted within the inner end of the knob sleeve 30, with its outer surface in rotatable bearing engagement with the inner surface of such knob sleeve 30. The cam sleeve has an outer end wall 49 and carries a rollback cam 50 at its opposite inner end. Such rollback cam 50 is out-turned from the wall of the cam sleeve and extends across the end of the knob sleeve 30, and thence into overlying relation with the end face 34 of the hub 24, so as to locate the cam sleeve 48 axially within the knob sleeve 30 and hub 24 and against outward movement. As shown in FIG. 4 and as is conventional, the rollback cams 32 and 50 have a normal position in which they are contiguous and coplanar, and their outer circumferential ends are in position to actuate cam faces 15 and 17 on the retractor 16, fragmental portions of which are shown in FIG. 4. The rollback cam sleeve 48 is connected for rotation by the key plug of the core 46 in the knob by a throw member 52 which is engaged in a transverse slot in the outer end wall 49 of the cam sleeve.

For purposes of locking the knob sleeve 30 against rotation so as to limit actuation of the lock to actuation by the key-actuated core 46, a bushing 54 is slidably mounted within the cam sleeve 48. Its range of movement is limited by a drive pin 53 fixed in the bushing and riding in an axial slot 55 in the cam sleeve 48. The inner end of the bushing is of reduced diameter and carries a locking finger 56 which, in the position shown in full lines, extends outward across the end of the knob sleeve 30 into the notch 58 formed at the inner end of the hub 24. In this position, it lies across and in clearance relation with an end face of the knob sleeve 30, so that the knob sleeve is free to rotate relative to the hub 24. To lock the knob sleeve against rotation, the bushing 54 and locking finger 56 are moved axially from the full-line position shown to the dotted-line position shown in FIG. 1, where the locking finger becomes engaged in a notch 59 in the end of the knob sleeve. The knob sleeve 24 and outside knob 36 will then be locked against rotation and operation of the bolt retractor 16 can be accomplished only by key actuation of the core 46. Such key actuation rotates the throw member 52 and cam sleeve 48 to cause the rollback cam 50 to move the bolt retractor 16. In certain lock functions, movement of the bushing 54 from its full-line position to its dotted-line position is effected from the inside knob of the cylinder lock, as by a push button in the inside knob which actuates a locking bar 60 to exert thrust on the bushing 54. The locking bar may be held in actuated position by a catch plate 62, as is known.

The mechanism thus far described may be considered representative of prior art cylinder lock mechanisms which have unsatisfactory knob-pull resistance. Pull on the knob 36 will be transmitted to the knob sleeve 30 by the knob retainer 40, and the transmitted pull on the knob sleeve 30 will be transmitted to the fixed hub 24 substantially entirely by the out-turned rollback cam 32.

Pull resistance has been improved in the past by providing the knob sleeve 30 with a stud 64, best shown in FIG. 3, but also shown in FIGS. 1 and 4. The stud projects radially outward from the wall of the knob sleeve 30 and may be formed by displacing outward from that wall a portion of the wall, by a half-perforation operation. For cooperation with such stud 64, the hub 24 is formed with an inner circumferential groove 66, located at the inner end of the notch 58 in the hub 24, so that such notch 58 provides an entranceway for passage of the lug 64 axially of the hub 24 to the location of the inner circumferential groove 66. As indicated in FIG. 3, assembly of the knob sleeve 30 in the hub 24 is accomplished by rotating the knob sleeve 30 180° clockwise from the position shown so as to position the lug 64 at the bottom and in alignment with the notch 58. The knob sleeve is then inserted axially into the hub 24, and the stud 64 passes axially through the notch 58 into the inner circumferential groove 66. The knob sleeve is then rotated counterclockwise to bring it back to the orientation shown in FIG. 3, with its rollback cam 32 at the top and in the orientation shown in FIGS. 3 and 4, which is its normal orientation relative to the chassis 12, 14 in the operative condition of the lock assembly. The stud 64 will thus be trapped in the inner circumferential groove 66, in the orientation shown in FIG. 4. Its outward side face will form an outward-presented shoulder, and the outer side face of the groove 66 will form an inward-presented shoulder for cooperation therewith to transmit outward pull from the knob sleeve 30 to the fixed hub 24.

In accordance with the present invention, pull resistance is enhanced by connecting the key-actuated rollback cam sleeve 48 to transmit pull from the knob sleeve 30 to the hub 24. As shown in FIGS. 3 and 4, the knob sleeve 30 is formed with a lug 70 which projects radially inward from the wall of the knob sleeve 30 and may be formed by deforming a narrow circumferential strip of such wall inward into a reversely curved configuration as shown. For cooperation with such lug 70, the cam sleeve 48 is formed with a bayonet slot having an axial entrance portion 72 extending through a notch 73 in the end wall 49, and thence into communication with a circumferential slot 74. Such circumferential slot preferably connects with the axial slot 55 in which the drive pin 53 rides. FIG. 3 shows the drive pin 53 which limits movement of the bushing 54 but for convenience of illustration omits the bushing itself.

The cam sleeve 48 (after assembly of the bushing 54 and drive pin 53 therewith) is assembled with the knob sleeve 30 either before or after the assembly of the knob sleeve with the hub 24. The cam sleeve 48 is oriented in the position shown in FIG. 3, and then inserted axially into the knob sleeve 30 so that the lug 70 passes through the entranceway 72 into alignment with the circumferential slot 74. The cam sleeve 48 is then rotated clockwise, as indicated by the arrow in FIG. 3, to cause the circumferential slot 74 to move to a position in which the lug lies in that slot, in the orientation shown in FIG. 4, remote from the entranceway. In such orientation, the rollback cam 50 lies adjacent the rollback cam 32 on the knob sleeve and the entranceway defined by the notch 72 is circumferentially displaced from the position of the lug 70 so that the lug is trapped near the closed end of the circumferential slot 74. The pull resistance enhancement provided by the lug 70 and bayonet slot 72–74 is desirably used in combination with the improvement provided by the stud 64 and groove 66 on the knob sleeve and hub. However, the lug 70 and slot 72–74 may be used separately and without also using the stud 64 and groove 66, and will serve to increase the pull resistance transmitted to the hub by the rollback cams 32 and 50.

The increase in pull resistance provided by the mechanism described occurs as follows. In the assembled relationship of the parts, as shown in FIGS. 1 and 4, pull on the knob 36 will be transmitted to the knob sleeve 30 by the knob retainer 40. The resulting pull on the knob sleeve 30 will be transmitted to the fixed hub 24, both by engagement of the out-turned rollback cam 32 with the end face 34 of the fixed hub 24, and also by engagement of the stud 64 with the outer end face of the inside groove 66 in such hub 24, in which groove the stud 64 is trapped. In addition, outward pull on the knob sleeve 30 will be transmitted from the outward side edge of the lug 70 against the inward-facing side edge of the circumferential slot 74 in the cam sleeve 48. This will transmit the pull to such cam sleeve 48, through it to the out-turned rollback cam 50 and thence against the end face 34 of the fixed hub 24. These actions resulting from the presence of the stud 64 and the presence of the lug 70 in accordance with the present invention greatly increase the pull resistance over that provided by the parts without such elements. When the lug 70 and groove 72–74 is used without also using the stud 64, pull on the knob sleeve will be transmitted direct to the rollback cam 32 and through the cam sleeve 48 to the rollback cam 50. Both cams will transmit such pull against the inner end of the hub 24 so as to produce increased pull resistance.

Increased pull resistance is most likely to be needed when the knob sleeve 30 and cam sleeve 48 are oriented as indicated in FIG. 4, where the rollback cams are retracted and inoperative to retract the bolt. In this arrangement of the parts, the stud 64 will be trapped in the inner circumferential groove 66 in an orientation in substantially direct alignment with the rollback cams 32 and 50 and well displaced from the notch 58 which forms the entranceway to that groove. Also, the lug 70 will be well displaced from the entranceway 72 indicated by the location of the notch 72 in FIG. 4, where it can act most effectively to increase pull resistance. The position of the lug 70 and slot 74 adjacent the outer end of the cam sleeve 48 leaves the inner end free to receive the bushing 54 and the operative end of the locking bar 60. It also permits the slot 74 to have a short entranceway with which it forms a bayonet lock slot, and this permits the knob sleeve 30 and cam sleeve 48 to be readily interlocked during assembly of the lock, without the need for any machine operations. The arrangement thus simplifies manufacture and permits enhanced pull resistance in substantially all functions for which the lock is otherwise adapted.

What is claimed is:

1. A cylinder lock, comprising a chassis having a fixed cylindrical hub, a knob sleeve rotatably mounted in the hub and having an out-turned rollback cam overlying the inner end of the hub for engagement therewith to transmit outward pull from the sleeve to the fixed hub, a key-actuated cam sleeve or the like within the inner end of the knob sleeve and having an out-turned rollback cam at its inner end in position to overlie the inner end of the hub and to transmit outward pull from such cam sleeve to the hub, outer means on the knob sleeve projecting radially outward therefrom within the length of the hub and defining an outward-facing shoulder, said hub having hub means forming a circumferentially extending rearward-facing shoulder positioned for engagement by said outward-facing shoulder to receive outward force from the knob sleeve, said shoulders being constructed and arranged to permit rotation of the knob sleeve in the hub for actuating said rollback cam, inner means on the knob sleeve projecting radially inward from its wall within the length of the cam sleeve and defining an inner outward-facing edge, said cam sleeve having means forming an inward-facing edge positioned for engagement by said inner outward-facing edge to receive outward force from the knob sleeve so that the cam sleeve and its rollback cam will transmit such force to the fixed hub.

2. A cylinder lock as in claim 1 in which said inner means comprises a lug projecting inward from the wall of the knob sleeve, and said edge-forming means on the cam sleeve comprises a circumferentially extending slot in the wall of the cam sleeve in which said lug rides when the cam sleeve is rotated relative to the knob sleeve to actuate the rollback cam on the cam sleeve.

3. A cylinder lock as in claim 2 in which said slot communicates with an axial opening through which the lug can be entered for engagement in said slot, such opening being circumferentially displaced from the operative position of the lug in the slot when the cam sleeve is oriented in the knob sleeve for operation of the rollback cam on the cam sleeve.

4. A cylinder lock, comprising a chassis having a fixed cylindrical hub, a knob sleeve rotatably mounted in the hub and having means thereon to transmit outward pull from the sleeve to the fixed hub, a key-actuated cam sleeve or the like within the inner end of the knob sleeve and having means in position to engage with the hub to transmit outward pull from such cam sleeve to the hub, wherein the improvement comprises inner means on the knob sleeve projecting radially inward from its wall within the length of the cam sleeve and defining an outward-facing edge, said cam sleeve having means forming an inward-facing edge positioned for engagement by said outward-facing edge to receive outward force from the knob sleeve so that the cam sleeve and its rollback cam will transmit such force to the fixed hub.

5. A cylinder lock as in claim 4 in which said knob sleeve means and cam sleeve means each comprises an out-turned rollback cam overlying the inner end of the hub in thrust-transmitting relation therewith.

6. A cylinder lock as in claim 4 in which said inner means comprises a lug projecting inward from the wall of the knob sleeve, and said means on the cam sleeve comprises a circumferentially extending slot in the wall of the cam sleeve in which said lug rides when the cam sleeve is rotated relative to the knob sleeve to actuate the rollback cam on the cam sleeve.

7. A cylinder lock as in claim 5 in which said slot communicates with an axial opening through which the lug can be entered for engagement in said slot, such opening being circumferentially displaced from the operative position of the lug in the slot when the cam sleeve is oriented in the knob sleeve for operation of the rollback cam on the cam sleeve.

8. A cylinder lock, comprising a chassis having a fixed cylindrical hub, a knob sleeve rotatably mounted in the hub and having an out-turned rollback cam overlying the inner end of the hub to transmit axial pull from the knob sleeve to the hub, a key-actuated rollback cam sleeve mounted in the knob sleeve and having an out-turned rollback cam overlying the inner end of the hub in position to transmit axial pull from the cam sleeve to the knob sleeve, and interengaging means adjacent the outer end of the cam sleeve for transmitting end pull from the knob sleeve to the cam sleeve and thereby transmitting such pull from the rollback cam of the cam sleeve to the hub to increase pull resistance over that provided by interengagement of the knob sleeve with the hub.

9. A cylinder lock as in claim 8 in which said interengaging means comprises a lug projecting inward from the wall of the knob sleeve and a bayonet slot in the cam sleeve in which such lug is engaged so as to transmit to the cam sleeve end pull exerted on the knob sleeve.

10. A cylinder lock as in claims 2, 6, or 9 in which the cam sleeve contains a bushing movable axially in the cam sleeve for locking the knob sleeve against rotation, said bushing being limited into movement by a pin engaged in an axial slot in the cam sleeve, said slot being connected with the lug-receiving slot in the cam sleeve.

11. A cylinder lock, comprising a chassis having a fixed cylindrical hub, a knob sleeve rotatably mounted in the hub and having an out-turned rollback cam overlying the inner end of the hub for engagement therewith to transmit outward pull from the sleeve to the fixed hub, a key-actuated cam sleeve or the like within the inner end of the knob sleeve and having an out-turned rollback cam at its inner end in position to overlie the inner end of the hub to transmit outward pull from such cam sleeve to the hub, wherein the improvement comprises one of said sleeves being formed with a bayonet slot and the other with a lug engageable in said slot to transmit outward force from the knob sleeve to the cam sleeve and its rollback cam so as to cause such rollback cam to transmit such force to the fixed hub.

* * * * *